US010021955B2

(12) United States Patent
Kax

(10) Patent No.: US 10,021,955 B2
(45) Date of Patent: Jul. 17, 2018

(54) LOCKING MECHANISM OF A BACKPACK

(71) Applicant: Thule IP AB, Malmö (SE)

(72) Inventor: Henrik Kax, Stockholm (SE)

(73) Assignee: Thule IP AB, Malmö (SE)

( * ) Notice: Subject to any disclaimer, the term of this patent is extended or adjusted under 35 U.S.C. 154(b) by 141 days.

(21) Appl. No.: 15/091,267

(22) Filed: Apr. 5, 2016

(65) Prior Publication Data

US 2016/0213127 A1 Jul. 28, 2016

Related U.S. Application Data

(63) Continuation of application No. 14/577,312, filed on Dec. 19, 2014, now Pat. No. 9,326,586.

(30) Foreign Application Priority Data

Dec. 20, 2013 (EP) ..... 13199148

(51) Int. Cl.
*A45F 3/04* (2006.01)
*A45F 3/12* (2006.01)

(52) U.S. Cl.
CPC ..... *A45F 3/047* (2013.01); *A45F 3/04* (2013.01); *A45F 3/12* (2013.01)

(58) Field of Classification Search
CPC .... A45F 3/04; A45F 3/12; A45F 3/047; A45F 3/042; A45F 3/06; A45F 3/08; A45F 2003/04; A45F 2003/146
USPC ..... 224/632, 627, 631
See application file for complete search history.

(56) References Cited

U.S. PATENT DOCUMENTS 4,013,201 A 3/1977 Potter
5,004,135 A * 4/1991 Dufournet ..... A45F 3/047 224/262
5,449,102 A * 9/1995 Sason ..... A45F 3/047 224/632
5,586,705 A * 12/1996 Leonard ..... A45F 3/047 224/627
5,628,443 A * 5/1997 Deutsch ..... A45C 7/0086 150/113

(Continued)

FOREIGN PATENT DOCUMENTS

CH 678 796 11/1991
DE 36 34 621 4/1988

(Continued)

OTHER PUBLICATIONS

European Search Report for European Application No. 13199148.1-1653, European Patent Office, Munich, DE, dated Jul. 14, 2014, 9 pages.

*Primary Examiner* — Brian D Nash
(74) *Attorney, Agent, or Firm* — Sterne, Kessler, Goldstein & Fox P.L.L.C.

(57) ABSTRACT

A locking mechanism for a shoulder strap of a backpack is disclosed which has guiding means, retaining means, and engaging means, where the engaging means is rotatable about an axis and slidably guided along the guiding means, where in a first rotational position the engaging means engages the retaining means so that a sliding movement of the engaging means along the guiding means is restricted, and where in a second rotational position the engaging means disengages the retaining means so that a sliding movement of the engaging means along the guiding means is enabled.

20 Claims, 13 Drawing Sheets

(56) References Cited

U.S. PATENT DOCUMENTS 5,704,530 A * 1/1998 Scherer ..... A45F 3/047 224/632
5,722,576 A 3/1998 Rogers
5,725,139 A * 3/1998 Smith ..... A45F 3/02 224/631
5,806,740 A * 9/1998 Carlson ..... A45F 3/047 224/259
D409,114 S * 5/1999 Bortner ..... D11/216
5,954,253 A * 9/1999 Swetish ..... A45F 3/08 224/628
5,961,014 A * 10/1999 Knerr ..... A45F 3/04 224/153
5,984,157 A * 11/1999 Swetish ..... A45F 3/10 224/631
6,098,859 A 8/2000 Bortner
6,179,175 B1 1/2001 Painter
6,550,651 B1 * 4/2003 Murdoch ..... A45C 5/143 190/18 A
7,152,771 B2 * 12/2006 Le Gal ..... A45F 3/047 224/631
7,507,141 B2 3/2009 Ward et al.
8,418,897 B1 * 4/2013 Young ..... A47D 13/025 224/158
8,474,109 B2 7/2013 Takazawa et al.
9,326,586 B2 * 5/2016 Kax ..... A45F 3/04
9,591,910 B2 * 3/2017 Kemp ..... A45F 3/047
2001/0030210 A1 10/2001 Donine
2003/0000986 A1 * 1/2003 Smith ..... A01K 97/10 224/637
2011/0284609 A1 11/2011 McGill et al.
2011/0309123 A1 * 12/2011 Ashenafi ..... A45F 3/14 224/627
2015/0173493 A1 * 6/2015 Kax ..... A45F 3/04 224/641
2016/0007720 A1 * 1/2016 Kemp ..... A45F 3/047 224/627

FOREIGN PATENT DOCUMENTS

EP 0 209 381 1/1987
EP 0 791 310 8/1997
FR 2 637 785 4/1990

* cited by examiner

LOCKING MECHANISM OF A BACKPACK

CROSS REFERENCE TO RELATED APPLICATIONS

This application is a continuation of U.S. application Ser. No. 14/577,312 (issued as U.S. Pat. No. 9,326,586 on May 3, 2016), which has a filing date of Dec. 19, 2014, the disclosure of which is hereby incorporated by reference in its entirety.

BACKGROUND OF THE DESCRIPTION

The present subject matter relates to a locking mechanism of a backpack and a backpack.

Known backpacks comprise shoulder straps spaced from each other in a horizontal direction and fixed to the backpack. Thus, the shoulder straps are not adjustable to e.g. the breadth across the shoulders of a user. This is inconvenient for a user carrying such a backpack.

Further, depending on the load carried with a backpack the mass center of a backpack varies. Thus, it is known to adjust the relative position of shoulder straps to a main body of the backpack and the backpack, respectively, with regard to the height of the shoulder straps relative to the backpack. However, such adjustments are inconvenient, complicated to use and also not stable enough to reliably resist forces acting on such a variable positioning of the shoulder straps.

SUMMARY

The present subject matter relates to a locking mechanism of a backpack and a backpack.

According to a first aspect of the subject matter a locking mechanism of a backpack comprises a guiding means, a retaining means, and an engaging means. Preferably, the engaging means is rotatable about a first axis and slidably guided along the guiding means. Thus, the engaging means can be moved rotationally and translationally, in particular about and along the guiding means.

Moreover, it is preferred that in a first rotational position the engaging means engages the retaining means so that a sliding movement of the engaging means along the guiding means is restricted. This means that due to a rotation of the engaging means a translational movement of the engaging means can be restricted. The rotation for engaging the engaging means with the retaining means can be done e.g. in a clock-wise direction.

Advantageously, in a second rotational position the engaging means disengages the retaining means so that a sliding movement of the engaging means along the guiding means is enabled. This implies that a rotation of the engaging means releases a translational movement of the engaging means, wherein for example the engaging means can be again slidably moved along the guiding means. The rotation for releasing and disengaging, respectively, can be done e.g. in a counter clock-wise direction.

Further, it is also possible that there are further rotational positions which means that it is preferred that according to an embodiment of the present subject matter the locking mechanism and the engaging means, respectively, comprise at least two rotational positions.

Describing the above mentioned in other words, the engaging means can be rotated in a first rotational position in which the engaging means engages the retaining means. This rotation can be done in a first direction. In this first rotational position the relative position of the guiding means and the retaining means along the guiding means is inhibited. This means that the engaging means cannot be further slid along the first axis and the guiding means, respectively. This is because the engaging means engages the retaining means where the position of the engaging means relative to the retaining means and the guiding means, respectively, is affixed.

Further, the engaging means can be rotated in a second rotational position so that the engaging means is disengaged with the retaining means. This rotation can be done in a second direction which is the opposite direction to the first direction. In this way the engaging means can be slid along the first axis and the guiding means, respectively, which means that the relative position along the guiding means of the engaging means and the retaining means is variable. Moreover, in the second rotational position the engaging means is freely movable.

This means simplified that the engaging means engages and disengages, respectively, the retaining means in dependence to its rotational position. Preferably, the rotational position is defined by the rotation direction and/or the rotation angle. Advantageously, the rotation angle is defined about an axis about which the engaging means is rotatable. A further definition of the rotation angle is the angle between the engaging means and the retaining means about an axis. Preferably, the axis about which the engaging means and the retaining means, respectively, is rotatable is shared by the engaging means and retaining means.

This means, depending on the rotation angle defined between the retaining means and the engaging means around a common axis of both means, the retaining means is engaged and disengaged, respectively, by the engaging means so that a sliding movement of the engaging means is restricted and enabled, respectively. The sliding movement is preferably made along the guiding means and/or along the common axis about which the engaging means and the retaining means, respectively, is rotatable.

According to an embodiment of the present subject matter, the engaging means comprises at least two portions. Preferably, a first portion of the engaging means provides an engagement with the retaining means. It is further preferred that a second portion of the engaging means provides a disengagement from the retaining means. Due to these at least two portions an engagement and disengagement, respectively, of the engaging means with the retaining means can be easily realized. Advantageously, the aforementioned two portions are placed around a first axis about which preferably the engaging means is rotatable. This allows an engagement and disengagement of the engaging means according to its rotation direction and rotation angle, respectively, defined about the first axis.

Preferably, the rotation angle for engaging is at least in a range of 0-60 degrees about the first axis about which the engaging means is rotatable. Advantageously, the angle is defined between the engaging means and the retaining means.

According to an embodiment of the present subject matter, it is preferred that the engaging means comprises substantially a disc-shape. Advantageously, the disc-shape is non-continuous with respect to a second axis. Non-continuous means that the engaging means comprises substantially a disc-shape having two different radii. Preferably, in each rotational portion of the engaging means a different radius is provided to realize the engagement and disengagement with the retaining means.

More concretely, for realizing the engagement of the engaging means with the retaining means the engaging means comprises preferably a substantially disc-shape having two different radii. Preferably, a radius in the first portion is greater than another radius in the second portion. This means that the engaging means of the locking mechanism provide engagement and disengagement from the retaining means depending on the radius.

Preferably, the disc-shape is provided only in the first portion of the engaging means for engaging with the retaining means. Advantageously, the disc-shape in the first portion of the engaging means is provided at least in a range of 0-60 degrees about a second axis of the disc-shaped engaging means. Thus, the locking mechanism is adapted to limit the translational movement of the engaging means, in particular along the guiding means. The limitation with respect to the retaining means can be realized in a certain range of a rotation angle about an axis about which the engaging means is rotatable.

It is also preferred that in a certain range, advantageously in a range of 0-60 degrees, the radius of the engaging means which comprises substantially a disc-shape is greater than a radius outside of mentioned range. Advantageously, the radii of the disc shape can be adapted to the range and the rotational positions, respectively.

Preferably, in a certain range in which the engaging means engages the retaining means the engaging means comprises any desired form and shape, respectively which enables an engagement of the engaging means with the retaining means. Moreover, it is preferred that outside a certain range the engaging means comprises a form and shape, respectively, for disengagement the engaging means from the retaining means.

Even further, it is also possible that in the first rotational position the engaging means comprises substantially a disc-shape, wherein in the second rotational position any desired form and shape, respectively, is realizable. For an easy realization of the rotational positions it is preferred that these positions of the engaging means relative to the retaining means are arranged about an axis, in particular about an axis of the engaging means.

The terms "engagement", "engaging" and "engage" used herein do in general mean that an engaging means is rotatable with respect to a retaining means, but not slidable. In other words, "engagement" provides a rotational but no translational movement. Thus, in the light of the foregoing, in the status "engaged" the engaging means can be rotatably moved but not slidably.

Further, the terms "disengagement", "disengaging" and "disengage" used herein do in general mean that a slidable and rotatable movement of the retaining means and the engaging means and vice versa is provided. Also here in other words, "disengagement" provides a rotational and a translational movement. Thus, in the light of the foregoing, in the status "disengaged" the engaging means can be moved rotational and translational to each other.

According to an embodiment of the present subject matter, the engaging means comprises a protrusion capable of engaging with the retaining means. The protrusion is preferably arranged in the first portion of the engaging means in which an engagement with the retaining means is provided. Advantageously, the protrusion is positioned in the first rotational position of the engaging means. By this a two-part engaging means is realized having at least one portion and position, respectively, for engagement and at least one portion and position, respectively, for disengagement with the retaining means.

According to an embodiment of the present subject matter, the retaining means comprises at least two recesses capable of being engaged by the engaging means. Preferably, in combination with the protrusion of the engaging means an easy, reliable and cost-effective locking mechanism can be realized. Then, the protrusion is able to engage the at least two recesses so that at least two different translational positions can be adopted. Thus, the engaging means can be locked in different positions of the retaining means spaced from each other. Having the guiding means in mind in combination with the retaining means and the engaging means, the engaging means can be slid along the guiding means, wherein the sliding is a translational movement. Further, as soon as the engaging means meets a recess of the retaining means the sliding along the guiding means is restricted.

Preferably, each retaining means realizes a receiving position. This means that a recess and the at least two recesses, respectively, form a receiving position capable of being engaged by the engaging means. Advantageously, the at least two recesses of the retaining means are arranged adjacent to each other. By this, an easy adjusting of the engaging means in different positions is realized.

Moreover, it is preferred that the at least two recesses of the retaining means are arranged substantially in parallel to an axis about which the engaging means is rotatable. In other words, it is preferred that the space between the retaining means and the engaging means is mainly equidistant, wherein preferably the engaging means is slidably guided along the guiding means. This means that the guiding means serves as guidance for the engaging means with respect to a translational movement, and in particular with respect to a rotational movement. The above explanations have the advantage that a reliable connection and engagement, respectively, of the engaging means with the retaining means is realizable.

According to an embodiment of the present subject matter, the at least two recesses built slots in the retaining means corresponding to the measurement of the engaging means. Preferably, the measurement of the retaining means and the slots, respectively, correspond to the protrusion of the engaging means. In this way, a fit of the engaging means with the retaining means can be made. Further, a loose fit of the protrusion of the engaging means with the at least two recesses of the retaining means and their slots, respectively, is preferred. Moreover, also a transition fit for the engaging means with the retaining means and the protrusion with the recesses is possible.

According to an embodiment of the present subject matter, the guiding means and the retaining means extend in the same direction. Preferably, the guiding means and the retaining means extend in parallel to each other. Thereby it is preferred that the guiding means guides a translational movement of the engaging means. This has the advantage that the engaging means can be guided such that an engaging and disengaging of the engaging means with the retaining means is easy and reliably realizable. It is further preferred that the engaging means and the retaining means are guided equidistant to improve engaging and disengaging of the engaging means with the retaining means. Advantageously, the guiding means allows a translation as well as a rotation of the engaging means along a direction along which the guiding means extends.

According to an embodiment of the present subject matter, at least one spacer means connects the guiding means and the engaging means. Advantageously, the at least one spacer means connects the guiding means and the retaining means in a constant distance to each other, preferably, equidistant. This has the advantage that engaging and disengaging of the engaging means with the retaining means is easy and reliable.

According to an embodiment of the present subject matter, the guiding means comprises a shaft, preferably, cylindrically-shaped, box-shaped or polygonally-shaped, in particular symmetrically-formed along an axis, in particular along the first axis. Such a shape guarantees a translational and rotational movement of the engaging means about and along, respectively, the guiding means.

According to an embodiment of the present subject matter, the second axis of the engaging means is coaxially aligned to the first axis, preferably about which the engaging means is rotatable. In other words, it is possible that the second axis of the engaging means and the first axis about which the engaging means is rotatable are the same and identical, respectively. Due to this arrangement an easy and reliable movement along and about such a common axis is possible.

According to an embodiment of the present subject matter, the engaging means comprises a buckle for arranging a shoulder strap of a backpack. This means, that besides the engaging and disengaging, respectively, of the engaging means with the retaining means, the engaging means has a further function, namely as a mount for a shoulder strap of a backpack. Thus, a shoulder strap can be mounted to the engaging means and the buckle, respectively.

Summarizing the above, in particular by using two engaging means for the locking mechanism the distance of the engaging means arranged on one guiding means is variable. Thus, by positioning a shoulder clasp to each engaging means the locking mechanism of a backpack can be adapted to the breadth across the shoulders of a user. Thus, a convenient wear comfort of such a locking mechanism for a shoulder strap of a backpack can be realized.

According to an embodiment of the present subject matter, the guiding means is made of metal, plastic and/or a compound material. Further, preferably the engaging means is made of plastic, metal and/or a compound material. In particular, the retaining means is made of metal, plastic and/or a compound material. Depending on the material the rigidity and stiffness of the aforementioned means can be adapted to the respective loading case.

According to a second aspect of the invention, a backpack comprises a locking mechanism having a retaining means which extends substantially in a horizontal direction and at least one guiding element extending in a substantially vertical direction. Thus, an assembly of the retaining means and the guiding element substantially similar to a cross is realized.

Preferably, the retaining means of the locking mechanism comprises at least one guide which guides a relative movement of the locking mechanism to the at least one guiding element. Advantageously, the relative movement between the locking mechanism and the guiding element is guidable by the at least one guide. Thus, the relative movement of the aforementioned locking mechanism and the at least one guiding element is typically predetermined by the extending direction of the at least one guiding element and the at least one guide. Further, an adjustment along the guiding element and a height adjustment of the retaining means, respectively, relative to the guiding element of the backpack can be realized. The height adjustment can be preferably in a vertical direction.

According to an embodiment of the present subject matter, the backpack employed in the second aspect can be structured as discussed for the first aspect and corresponding embodiments.

According to an embodiment of the present subject matter, the backpack comprises a shoulder clasp having at least one shoulder pad and least one shoulder strap. Preferably, the at least one shoulder pad and the at least one shoulder strap are sewed to each other. This is an easy and fast way to mount the at least one shoulder pad to the at least one shoulder strap. In this way, also a reliable and cost effective mount can be realized. In a preferred embodiment the shoulder clasp comprises one pad and two shoulder straps, wherein preferably the shoulder straps are mounted to the pad. By this, assembly costs for production can be reduced as fewer parts for a further utilization have to be handled.

Advantageously, a surface of the at least one shoulder pad interacts with a surface of the at least guiding element. The interaction of the two surfaces is preferably realized in a detachable manner such that the surface of the at least one shoulder pad can be any number of times detached and attached from and to, respectively, each other. Thus, a solvable and reliable connection between the surfaces of the at least one guiding element and the at least on shoulder pad is realized.

According to an embodiment of the present subject matter, the surfaces of the at least one guiding element and the shoulder clasp, in particular the at least one shoulder pad, comprise mating members of a hook-and-loop fastener. This is an easy, cost-effective and reliable solution for realizing a detachable manner such that the surfaces of the at least one shoulder pad and the at least one guiding element can be any number of times detached and attached from and to, respectively, each other.

According to an embodiment of the present subject matter, the at least one shoulder strap and the at least one shoulder pad are pivotably arranged at the locking mechanism. By this, the shoulder clasp can be rotated about the locking mechanism. Due to this articulation about the locking mechanism in an easy way the mating members of surfaces of at least one guiding means and a shoulder clasp can be detached and attached.

According to an embodiment of the present subject matter, the at least one shoulder pad is mounted to the retaining means of the locking mechanism and the at least one shoulder strap is mounted to engaging means of the locking mechanism. Thus, the locking mechanism preferably also comprises engaging means. Moreover, the engaging means is rotatable preferably about an axis, in particular about a first axis. Moreover, the engaging means is also advantageously slidably guided. The movements of the engaging means are in particular about and/or along guiding means. Thus, the engaging means can be moved rotationally and translationally, in particular about and along the guiding means.

Further, the at least one shoulder pad is preferably positioned between the retaining means and the at least one shoulder pad of the shoulder clasp. Typically, the at least one shoulder pad comprises two ends, wherein an end is connected to the retaining means and another end is connected to the at least one shoulder strap of the shoulder clasp. Again, the at least one shoulder pad is positioned in the middle of the retaining means of the locking mechanism and the at least one shoulder strap.

Further, advantageously the at least one shoulder strap is also connected to the locking mechanism and the engaging means, respectively. Thus, the above mentioned connections can form a loop. Moreover, it is preferred that a connection of the least one shoulder pad and the at least one shoulder strap with the locking mechanism comprises a triangle arrangement having at least one acute triangle with a small angle and at least one maximized further angle. In other words, it is advantageous that a triangle arrangement having the least one pad, the at least one shoulder strap and the retaining means of the locking mechanism comprises two edges on the locking mechanism.

Preferably, the two edges comprise a short side of the triangle in between so that a pivoting movement of the third edge of the triangle about the short side is possible. Such an arrangement could e.g. comprise the angles 2 degrees for the acute angle and 89 degrees for each maximized further angle. Also possible is an arrangement with an acute angle, a maximized angle and a further acute angle. Such an arrangement could comprise the angles 1 degree, 1 degree and 178 degree. The above mentioned range of different angle of a triangle and of a triangle arrangement, respectively, results in the pivoting movement of one acute angle about its opposite side.

More concretely, the at least one shoulder pad and at least a part of the at least one shoulder strap are superposed. Further, as the at least one shoulder pad and the at least one shoulder strap preferably comprise an edge at which both are typically connected to each other, an acute angle at the connection can be realized. In this context, opposite to this acute angle a short side can be assured, wherein the short side is mainly parallel positioned to the retaining means and the locking mechanism, respectively. In this way, the at least one shoulder strap together with the at least one shoulder pad can be moved together and pivoted about the short side, respectively. In doing so, it is preferred that the surfaces of the at least one shoulder pad and the at least one shoulder strap are in contact with each other. Moreover, the rotation angle of such an arrangement can be 180 degree preferably measured from the orientation of the retaining means of the locking mechanism.

According to an embodiment of the present subject matter, in a first state the shoulder clasp interacts with the at least one guiding element such that the relative position of the locking mechanism and the at least one guiding element is restricted. Preferably, the first state is realized by interacting of mating members of a hook and loop fastener provided on surfaces of the at least one guiding element and the shoulder clasp, in particular the at least one shoulder pad.

Advantageously, in a second state the contact of the shoulder clasp with the at least one guiding element is inhibited such that the relative position of the locking mechanism and the at least one guiding element is adjustable. It is preferred that in the second state the mating members of the at least one guiding element and the shoulder clasp, in particular the at least one shoulder pad, are spaced from each other so that there is no interaction between mating members. Thus, the position of the shoulder clasp and the at least one guiding element or the at least one guiding element and the at least one shoulder pad of the shoulder clasp can be adjusted to any desired position. This adjustment can be realized by moving the locking mechanism and the shoulder clasp along the at least one guiding element in a substantially vertical direction, wherein the at least one guiding element predetermines the direction of movement of the locking mechanism relative to the at least one guide.

Describing the above mentioned in other words, in a first state in which the shoulder clasp interacts with the at least one guiding element, the at least one shoulder pad of the clasp is preferably in contact with the at least one guiding element via mating members. By this, the position of the locking mechanism relative to the at least one guiding element is also fixed. This is because the shoulder clasp and its at least one shoulder pad, respectively, is connected to the locking mechanism and the engaging means, respectively. This means that the locking mechanism cannot be moved along the guiding elements. Thus, there is no adjustability in the first state.

In a second state in which the shoulder clasp comprises no interaction with the at least one guiding element, the at least one shoulder pad of the clasp is preferably spaced from the at least one guiding element so that no mating members can be engaged. This can be realized e.g. by pivoting the at least one shoulder pad of the shoulder clasp about the locking mechanism. This enhances the distance between the at least one shoulder pad and the at least one guiding element.

To switch between the first and second state the at least one shoulder pad is typically rotated. In this first state and rotational state, respectively, a change in position of the relative position of the at least one guiding element and the locking mechanism along the at least one guiding element is inhibited. This means that the locking mechanism cannot be slid along the at least one guiding element. This is because mating members of the at least one guiding element engages with the at least one shoulder pad, wherein the at least one shoulder pad is rotatably connected to the locking mechanism and the engaging means, respectively.

Further, the at least one shoulder pad can be rotated in a second state so that the mating members of the at least one shoulder pad and the at least one guiding element are disengaged with each other. By this, the locking mechanism can be slid along the at least one guiding element which means that the relative position along the at least one guiding element of the backpack and the locking mechanism is variable. Moreover, in the second state the locking mechanism is freely movable along the at least one guiding element, preferably in a vertical direction.

This means simplified that the at least one shoulder pad of the shoulder clasp engages and disengages, respectively, the at least one guiding element in dependence to their relative position to each other. Preferably, the rotational position is defined by the rotation direction and/or the rotation angle. Advantageously, the rotation angle is defined about an axis around which the at least one shoulder pad is rotatable. A further definition of the rotation angle is the angle between the at least one shoulder pad and the at least one guiding element about an axis. Preferably, the angle between the at least one guiding element and the at least one shoulder pad of the shoulder clasp is mainly zero for engaging with mating members placed on each other and for no sliding along the at least one guiding element.

This means, depending on the rotation angle defined between the at least one shoulder pad and the at least one guiding element around a common axis of both, the at least one shoulder pad is engaged and disengaged, respectively, by the mating members so that a sliding movement of the at least one shoulder pad is restricted and enabled, respectively. The sliding movement is preferably made along the at least one guiding element and/or mainly rectangular to the axis about which the at least one shoulder pad is slidably movable.

According to an embodiment of the present subject matter, in the second state the shoulder clasp is rotated about the locking mechanism to inhibit the contact with the at least one guiding element. Thus, due to a rotational movement of the shoulder clasp about the locking mechanism the contact of the surfaces of the at least one guiding element and the shoulder clasp, respectively, is released so that a relative movement between these both parts is possible. In this context, an angle between the at least one guiding element and the at least one shoulder pad is preferably greater than zero.

DESCRIPTION OF THE EMBODIMENTS

In the following, embodiments of the present subject matter are explained based on the drawings. It is noticed that drawings show a specific embodiment as explained below and further alternative modifications as specified in the description are at least in part not illustrated. Further, same reference signs used in the figures denote the same components.

Figure 1:
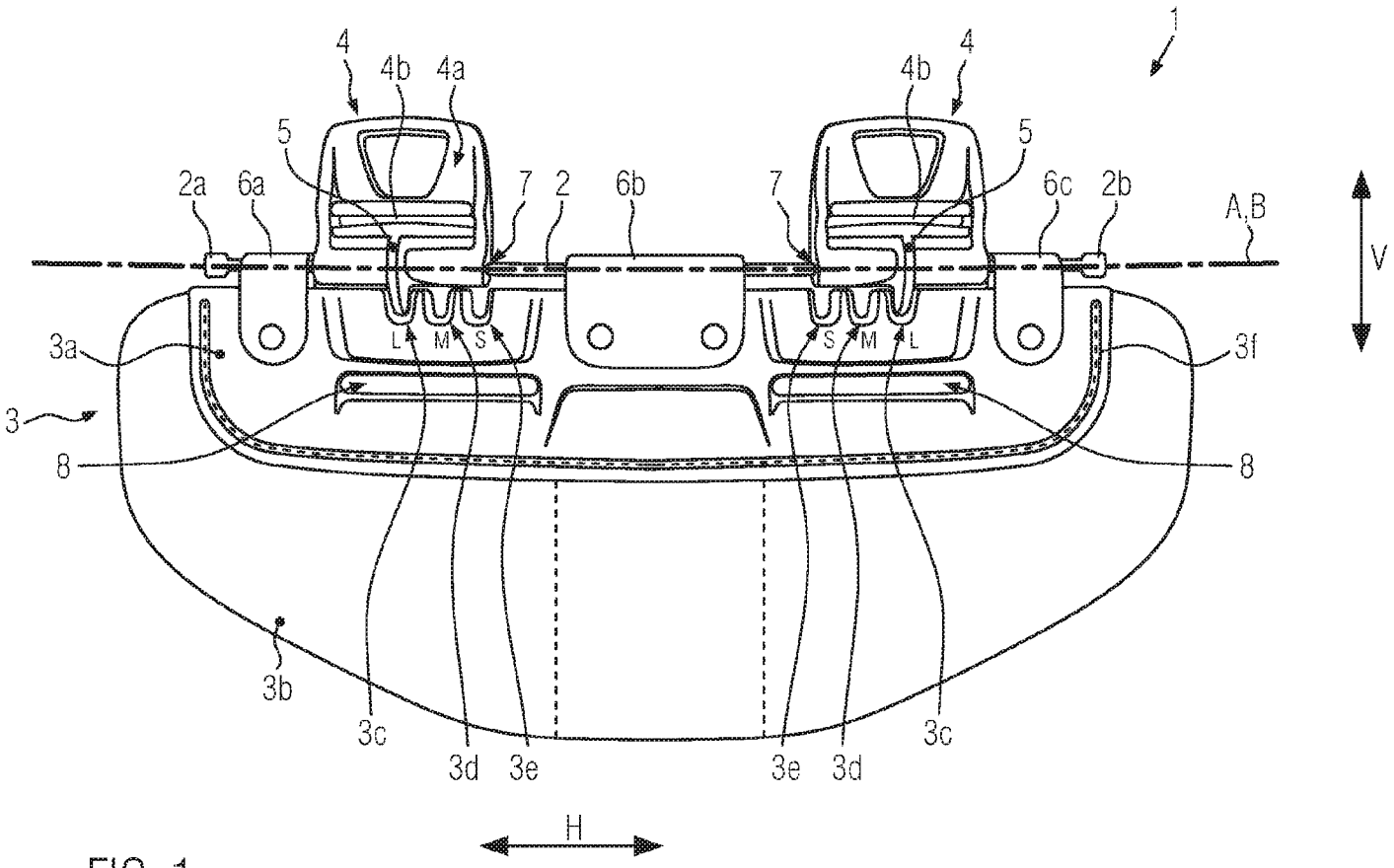
FIG. 1 shows a plan view of a locking mechanism in a first locking position.

In FIG. 1 a plan view of an embodiment of a locking mechanism 1 of a backpack 20 of the present subject matter is shown in a first position. The locking mechanism 1 comprises guiding means 2, retaining means 3 and engaging means 4.

The guiding means 2 comprises a mainly cylindrically-shaped shaft, preferably symmetrically-formed along axis A which extends substantially in a horizontal direction H. Advantageously, the guiding means 2 is made of metal e.g. aluminium. Further, the guiding means 2 has thickened ends 2*a*, 2*b* so that detaching the shaft of the guiding means 2 is restricted in the horizontal direction. Also other shapes for mentioned shaft and guiding means, respectively, are possible, meaning that a desired shaft could also be box-shaped or polygonally-shaped, in particular symmetrically-formed along axis A.

The engaging means 4 comprises a buckle 4*a* with a port 4*b*, a through-hole 7 and a protrusion 5. The buckle 4*a* and the port 4*b*, respectively, wherein the port 4*b* extends mainly in the horizontal direction H, are adapted for arranging a shoulder strap 24 of a backpack 20 (not shown). Thus, the buckle 4*a* and the port 4*b*, respectively, can be used for connecting the engaging means 4 to a shoulder strap 24 of a backpack 20 as the shoulder strap can be guided through the port 4*b*.

Moreover, the through-hole 7 of the engaging means 4 comprises axis B about which the engaging means is rotatable. The through-hole 7 serves as a retainer for the guiding means 2 and its shaft, respectively.

Axis B of the engaging means 4 and the through-hole 7, respectively, is coaxially aligned to axis A of the cylindrically-shaped shaft of the guiding means 2. The through-hole 7 as well as the outer diameter of the guiding means' shaft are fitted such that the engaging means 4 are rotatable about and slidable along axis A of the guiding means 2. Thus, the engaging means 4 can be rotationally and translationally moved about and along, respectively, axis A of the guiding means 2. In other words, the through-hole 7 of the engaging means 4 comprises a transition fit or a loose fit with the shaft of the guiding means 2. Thus, an easy way for rotating and moving the engaging means 4 about and along the guiding means 2 is realized.

The shaft of the guiding means 2 is connected to the retaining means 3 via spacer means 6*a*, 6*b*, 6*c*. These spacer means 6*a*, 6*b*, 6*c* connects the guiding means 2 and the retaining means 3 in a constant distance to each other. This distance is adapted to the measurement of the protrusion 5 such that the protrusion 5 engages optimally the retaining means 3. Each spacer means 6*a*, 6*b*, 6*c* comprises a thin bended metal plate formed in a U-shape, wherein the open end of the "U" is riveted to and points to the retaining means 3, whereas the closed end of the "U" holds the guiding means 2 in a distance to the retaining means 3. Thus, the spacer means 6*a*, 6*b*, 6*c* spaces the guiding means and its shaft, respectively, from the retaining means in a predetermined distance which is preferably equidistant.

As already described above, the guiding means 2 comprises thickened ends 2*a*, 2*b*. The thickness of these ends is adjusted to the U-shaped spacer means 6*a*, 6*b*, 6*c* such that the guiding means 2 cannot be removed from the locking mechanism 1 in a horizontal direction H as the thickened ends comprise greater dimensions than the U-shape of the distance means. Thus, the thickened ends cannot pass through the "U" in a horizontal direction H.

Further, also removing in a vertical direction V is restricted because of the closed end of the U-shaped distance means 6 and because of the opposite open end of the U-shape which is riveted to the retaining means 3.

As can be further seen in FIG. 1, the guiding means 2 and the retaining means 3 extend in the same direction, substantially parallel to each other. The retaining means 3 comprises a molded part 3*a* and a textile part 3*b* which are stitched together along line 3*f*. The textile part 3*b* comprises substantially a V-shape, wherein at the "upper open end of the V-shape" the molded part 3*a* is positioned. The molded part comprises several recesses 3*c*, 3*d*, 3*e* for joining with the protrusion 5 of the engaging means 4 as well as two guides 8 for guiding a guiding element 21 of a backpack 20 (not shown).

The recesses 3*c*, 3*d*, 3*e* are realized as slots in the molded part 3*a* of the retaining means 3. The measurements of the engaging means 4 and the slots of the recesses, respectively, correspond to the protrusion 5 of the engaging means 4. The measurements realize a transition fit or a loose fit of the engaging means 4 and its protrusion 5, respectively, with the retaining means 3 and the recesses, respectively. Thus, it is easily possible for the protrusion 5 to run in and out of the recesses 3*c*, 3*d*, 3*e*.

Figures 2A, 2B, 2C, 2D:
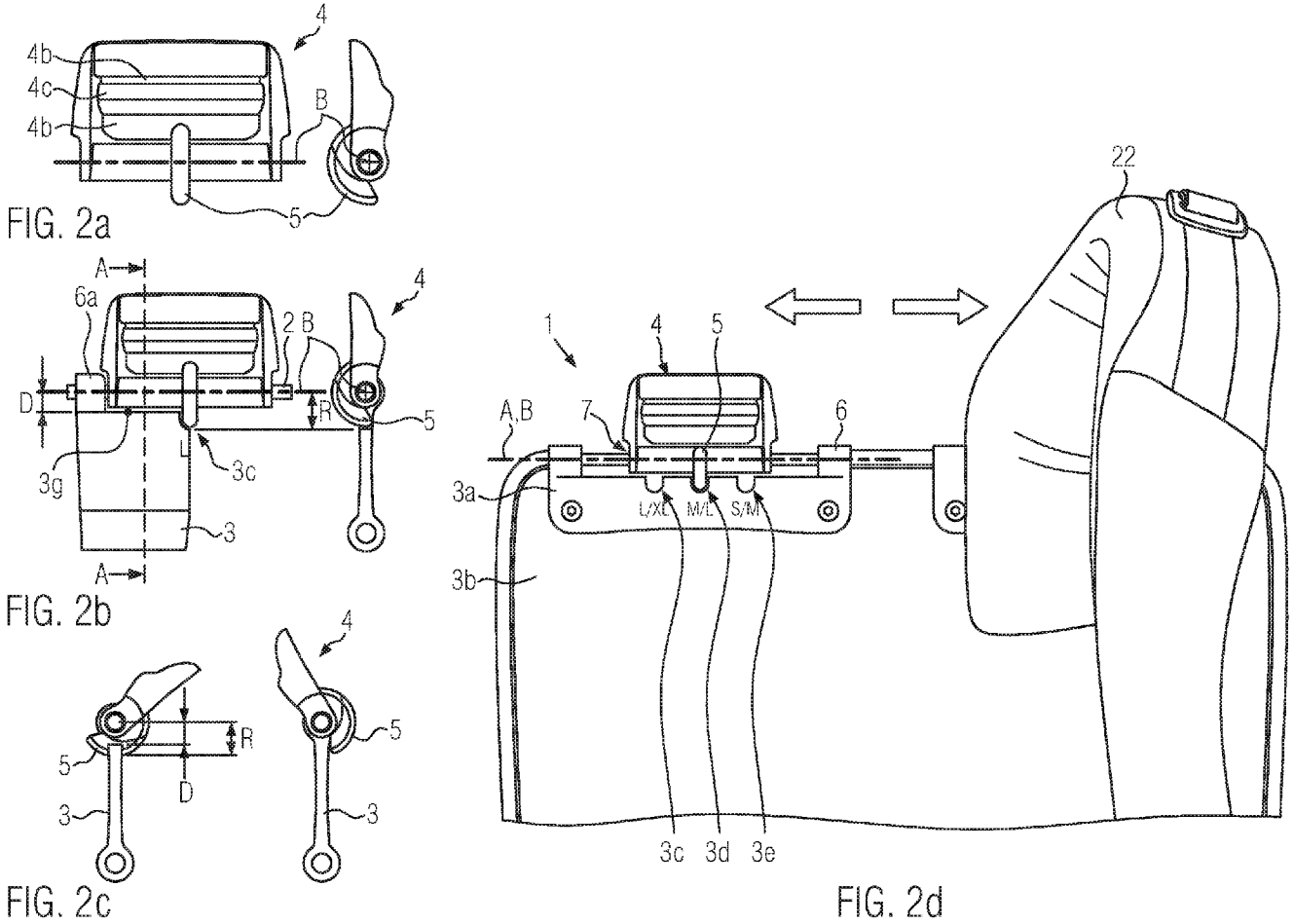
FIG. 2*a* shows a plan view and a side view of the engaging means of the locking mechanism of FIG. 1.
FIG. 2*b* shows a plan view and a side view of the engaging means and of the retaining means of the locking mechanism of FIGS. 1 and 2*a;*
FIG. 2*c* shows a cross section of FIG. 2*b* along line A-A in a first rotational position and in a second rotational position.
FIG. 2*d* shows a plan view of the locking mechanism of FIG. 1 according to a further embodiment.

FIG. 2*a* shows a plan view and a side view of engaging means 4 of the locking mechanism 1 similar to that shown in FIG. 1.

In this embodiment the engaging means 4 comprises two ports 4*b* and a bar 4*c* formed in between the two ports. Thus, a maze is formed through which a pathway is built guiding a strap. The pathway and the maze, respectively, produce in connection with the strap (not shown) a friction force. This friction force makes it difficult for the strap to move. Thus, the strap is clamped within the maze. Therefore, the maze and the two ports 4*b*/the bar 4*c*, respectively, can be used to mount a shoulder strap to the locking mechanism 1.

Further, in FIG. 2*a* the protrusion 5 of the engaging means 4 is shown. The special embodiment of the protrusion 5 can be easily seen on the right side of FIG. 2*a*. As shown here, the engaging means 4 and the protrusion, respectively, comprises at least two portions, wherein in a first portion of the engaging means an engagement with the retaining means 3 is provided and in a second portion of the engaging means 4 a disengagement from the retaining means 3 is provided. In other words, the protrusion 5 of the engaging means 4 comprises a non-continuous disc-shape with respect to axis B.

The first portion of the engaging means 4 providing an engagement with the retaining means 3 comprises a disc-shape, whereas the second portion of the engaging means 4 comprises no protrusion in the form of a disc-shape so that a disengagement of the protrusion 5 with the retaining means and its recesses, respectively, is enabled.

The other way round, the disc shape is provided only in the first portion of the engaging means 4 for engaging with the retaining means 3, wherein the disc-shape on the first portion of the engaging means 4 is provided in a range of 0 to 180 degrees about the axis B of the disc-shaped engaging means 4 and the protrusion 5, respectively.

No disc-shape is provided in the second portion of the engaging means 4 so that an engaging of the retaining means 3 with the engaging means 4 is not possible. This means that the engaging means 4 comprises in a range of 180 to 360 degrees about the axis B no disk-shape.

The protrusion 5 is part of the engaging means 4, wherein preferably the protrusion is integrally molded with the engaging means 4. Depending on the angle of rotation of the engaging means 4 about the axis B, the protrusion 5 also changes its position.

FIG. 2*b* shows a plan view and a side view of the engaging means 4 and of the retaining means 3 of the locking mechanism 1. As mentioned above, the protrusion 5 of the engaging means 4 is capable of engaging with the retaining means 3. Moreover, the protrusion engages a recess of the retaining means 3.

The left side of FIG. 2*b* differs from the left side of FIG. 2*a*. Additionally the guiding means 2 are shown, wherein the engaging means 4 is rotationally aligned about the guiding means 2. Further, the spacer means 6 (another embodiment of the spacer means is shown compared to the FIG. 1) holds the guiding means in connection to the retaining means 3 and both means substantially equidistant to each other. Thus, the locking mechanism 1 is mainly completely shown.

On the right side of FIG. 2*b* a side view of the retaining means 3 and the engaging means 4 mounted on the guiding means 2 is shown, wherein the retaining means 3 is mainly equidistant positioned to the guiding means 2 by the spacer means 6 (not shown).

In FIG. 2*b* it is also shown that the axis B of the engaging means 4 is coaxially aligned to axis A of the guiding means 2. This enables a rotation of the engaging means about the axis A, B and the guiding means 2, respectively.

FIG. 2*c* shows a cross section of FIG. 2*b* along line A-A in a first rotational position and in a second rotational position.

On the left side of FIG. 2*c* the first rotational position of the engaging means 4 relative to the retaining means 3 is shown. In this position the engaging means 4 engages the retaining means 3 so that a sliding movement of the engaging means 4 along the guiding means 2 is restricted. The engagement is realized by the disc-shaped protrusion which is provided only in the first portion of the engaging means 4, in particular in a certain range, namely in a range of 0 to 180 degrees about axis B of the disc shaped engaging means 4 and the protrusion 5, respectively. With this disc-shape protrusion 5 in the first portion of the engaging means 4—as can be clearly seen in FIG. 2*c*, shown on the left side—the engaging means 4 engages the retaining means 3, in particular the recess 3*c*.

Moreover, the protrusion 5 comprises a radius R which is greater than the distance D of the axis B to the upper edge 3*g* of the retaining means 3. Thus, the engaging means 4 overcomes the distance D and extends into the retaining means 3. In this way, an engagement of the engaging means 4 and the protrusion 5, respectively, with the retaining means 3 and the recess 3*c*, respectively, is realized.

On the right side of FIG. 2*c* the second rotational position of the engaging means 4 relative to the retaining means 3 is shown. In the second rotational position the engaging means 4 disengages the retaining means 3 so that a sliding movement of the engaging means 4 along the guiding means' 2 shaft is enabled.

As shown on the right side of FIG. 2*c* the engaging means 4 is in comparison to the depiction on the left side rotated in counterclockwise so that the protrusion 5 disengages the recess 3*c* of the retaining means 3. Moreover, no disc-shaped protrusion 5 is provided in the second portion of the engaging means 4 so that an engaging of the retaining means 3 with the engaging means 4 is not possible. Thus, in the second rotational position the engaging means 4 and the non-continuous disc-shaped protrusion 5, respectively, is relatively positioned to the retaining means such that the second portion of the engaging means 4 enables a disengagement of the engaging means 4 with the retaining means 3.

This means that the engaging means 4 comprises in the second portion in a range of 180 to 360 degrees about the axis B no disk-shape. Therefore, depending on the rotation angle of the engaging means 4 relative to the retaining means 3 and depending on the range of the protrusion 5 in which a disc-shape is provided, the angle of engaging and disengaging of the engaging means 4 with the retaining means 3 is defined. Thus, this defines the range in which the engaging means 4 engages and disengages, respectively, the retaining means 3.

FIG. 2*d* shows a plan view of the locking mechanism 1 of FIG. 1 according to a further embodiment.

Moreover, FIG. 2*d* shows engaging means 4 engaged with the retaining means 3. As can be easily understood with regard to FIG. 2*d*, if the retaining means 3 is rotated such about the guiding means 2 that the protrusion 5 disengages the retaining means 3, the retaining means can be slit along the axis A, B. The sliding movement is limited by spacer means 6.

In the embodiment shown in FIG. 2*d* the retaining means 3 comprises a metal part 3*a* and a textile part 3*b*. A portion of the part 3*a* forms a spacer means 6 guiding and holding the shaft of the guiding means 2 mainly equidistant.

In FIG. 2*d* a left and a right arrow is shown. These arrows indicate the movement of the engaging means 4 relative to the retaining means 3. Moreover, on a further engaging means 4 (not shown) on the right side of the retaining means 3 a shoulder clasp 22 is positioned. This shoulder clasp 22 comprises a strap (not shown) which is guided through the maze of the engaging means 4.

Figure 3B:
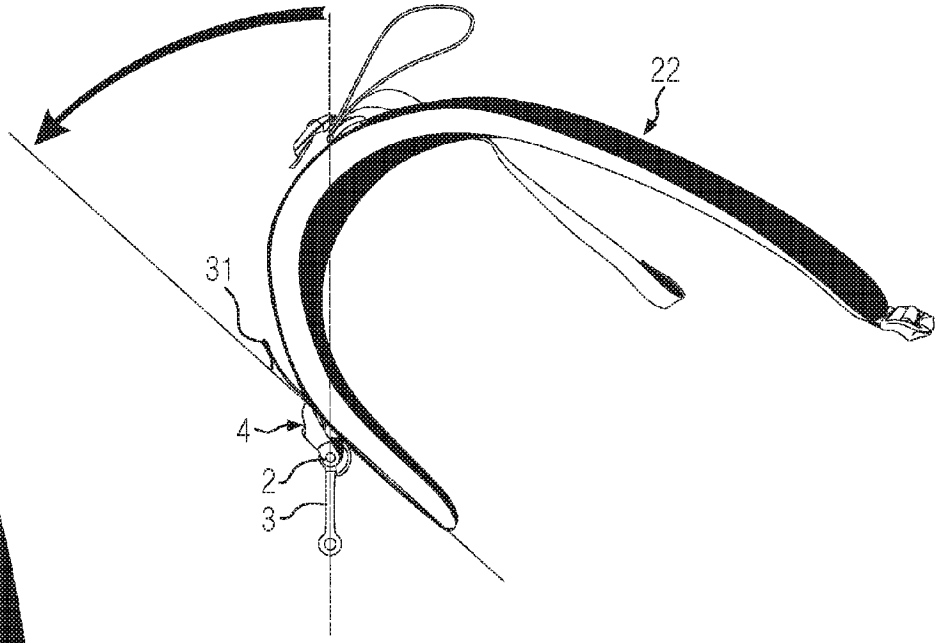
FIG. 3*b* shows a side view of the engaging means and the retaining means of the locking mechanism in a second rotational position.
Figure 3A:
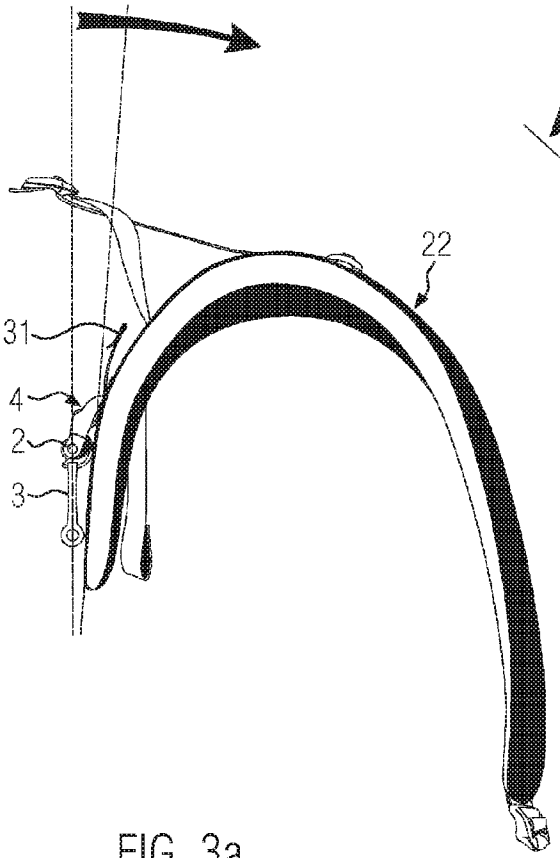
FIG. 3*a* shows a side view of the engaging means and the retaining means of the locking mechanism in a first rotational position.

FIG. 3*a* shows a side view of the engaging means 4 and the retaining means 3 of the locking mechanism 1 in the first rotational position.

In this position the engaging means 4 and its protrusion 5, respectively, engages the retaining means 3 and one of its recesses 3*c*, 3*d*, 3*e*, respectively, so that a sliding movement of the retaining means along the shaft of the guiding means 2 is restricted. As can be further seen in FIG. 3*a*, a shoulder clasp 22 is mounted to the retaining means 3 via a strap 31 which is guided through the maze of the engaging means 4 as shown in the Figure.

As can be also seen in FIG. 3*a* for engaging the engaging means with the retaining means a rotation about the guiding means in a clockwise direction is done.

FIG. 3*b* shows a side view of the engaging means 4 and the retaining means 3 of the locking mechanism 1 in the second rotational position.

The engaging means 4, retaining means 3 and the shoulder clasp 22 as already shown in FIG. 3*a* are now depicted in the second rotational position in which the protrusion 5 of the engaging means 4 disengages the retaining means 3 while the shoulder clasp 22 mounted to the engaging means 4 and the retaining means 3, respectively, is rotated in a counter-clockwise direction. Now, the shoulder clasp 22 and the engaging means 4 are slidable along the guiding means 2 and its axis B, respectively.

Figure 4:
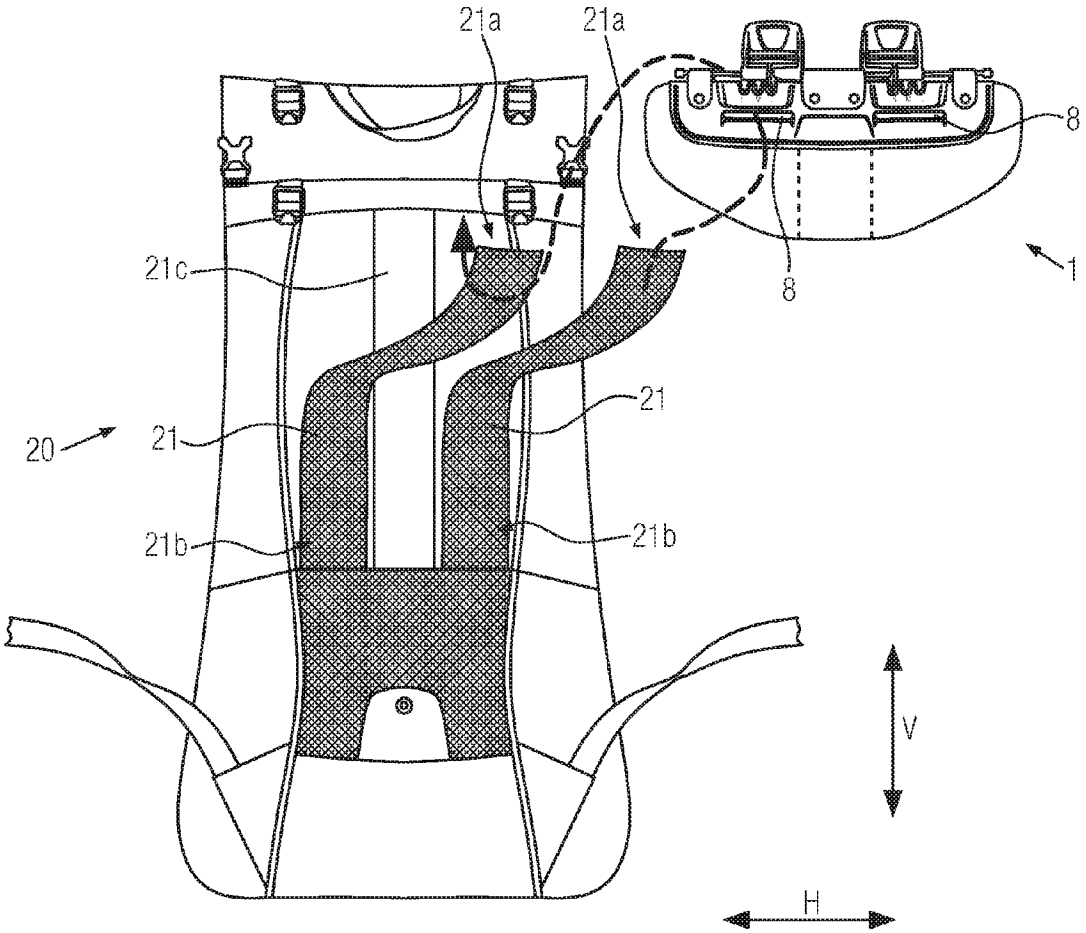
FIG. 4 shows a plan view of a backpack as well as a locking mechanism as shown in FIG. 1.

FIG. 4 shows a plan view of a backpack 20 as well as a locking mechanism 1 as shown in FIG. 1.

Moreover, FIG. 4 shows a locking mechanism 1 having a retaining means 3 which extends substantially in a horizontal direction H and two guiding elements 21 extending in a substantially vertical direction V, wherein the retaining means 3 comprises two guides 8 guiding a relative movement of the locking mechanism 1 to the two guiding elements 21.

In other words, FIG. 4 shows the mounting of the locking mechanism 1 to a backpack 20 wherein guiding elements 21 of the backpack 20 are guided through the guides 8 of the locking mechanisms' retaining means 3 from one side and surface, respectively, of the retaining means to the other.

The guiding elements 21 comprise two ends, wherein a lower end 21*b* is sewed with a further part of the backpack 20. The upper ends 21*a* are guided through the guides 8 and then mounted and sewed, respectively, to the backpack 20. Thus, a sewed connection between the ends of the guiding elements 21*a, b* and the backpack 20 is realized. Further, also the locking mechanism 1 and the retaining means 3, respectively, are in this way mounted to the backpack 20. Additionally, a further guiding element 21*c* can be installed to the backpack 20. This guiding element 21*c* is preferably rigid a formed, preferably similar to a metal strip. This helps to reinforce the backpack 20, in particular in the vertical direction V.

Figure 5:
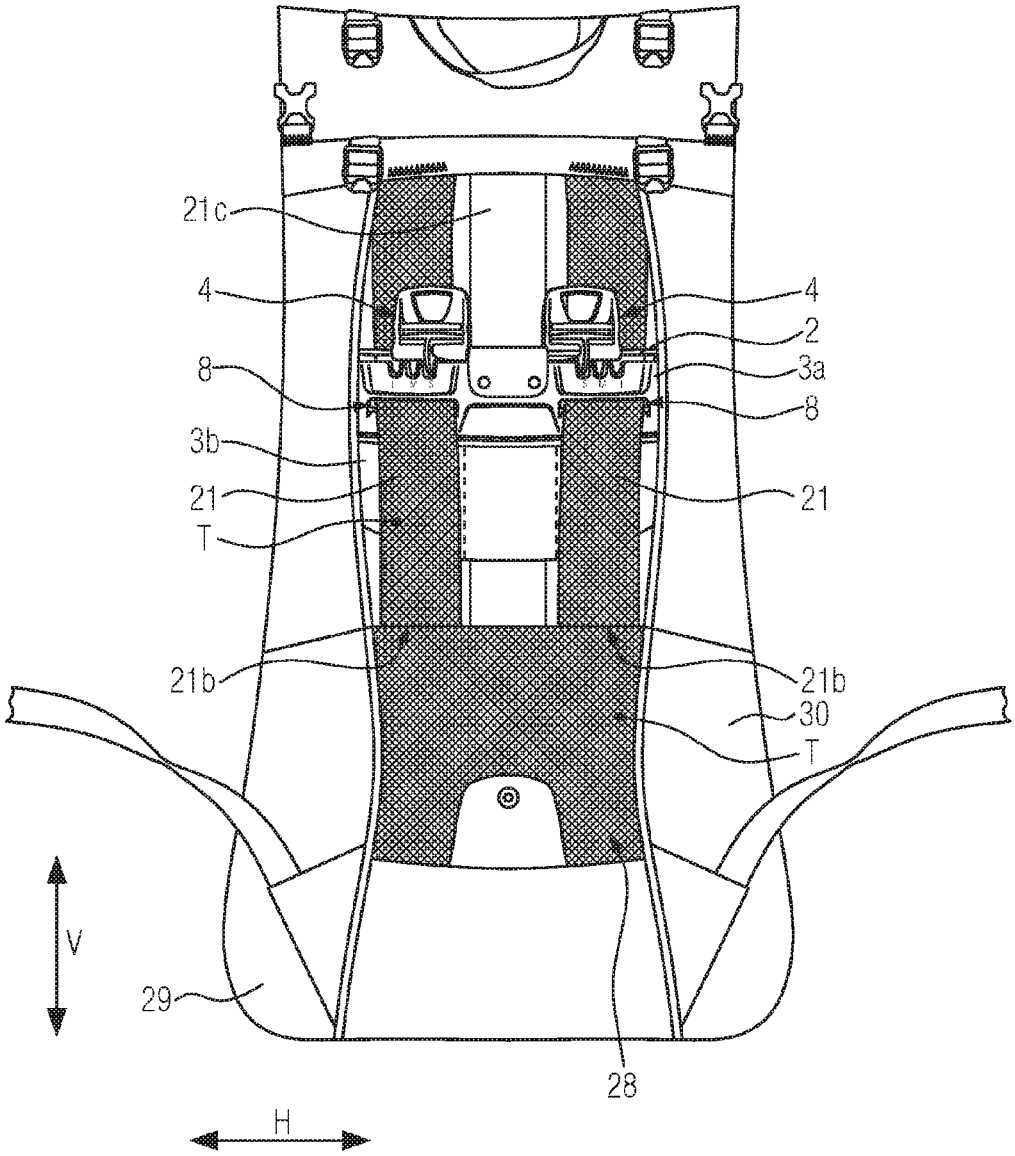
FIG. 5 shows the back of a backpack as well as a mounted locking mechanism in a plan view and in a first relative position to each other.

FIG. 5 shows the back of a backpack 20 as well as a mounted locking mechanism 1 in a plan view and in a first relative position to each other.

Further, the locking mechanism 1 is mounted to the backpack 20 via the guiding elements 21. As can be seen in FIG. 5, the embodiment of the locking mechanism 1 as shown in FIG. 1 is mounted. Here, the retaining means 3 comprises the molded part 3*a* as well as the textile part 3*b*, wherein the molded part 3*a* comprises two guides 8 through which the guiding elements 21 are guided.

The guiding elements 21 are guided along a first side and surface, respectively, of the textile part 3*b* and the molded part 3*a*. Moreover, after the guide 8 of the retaining means 3 passes through guides 8, the guiding elements 21 arrive at the other side and surface, respectively, of the retaining means 3. The other way round, the guiding elements 21 are guided along a first surface of the retaining means 3, pass through the guides 8 and arrive at the second side of the retaining means 3. Thus, the guiding elements 21 are due to their way through the guides 8 similar shaped to an "S".

Further, the locking mechanism 1 comprises the already mentioned engaging means 4, guiding means 2 as well as the protrusion 5 and the recesses 3*c*, 3*d*, 3*e*.

Moreover, the guiding elements 21 comprise a surface T having mating members of a hook-and-loop fastener. This special surface T extends not only on one side of the guiding elements 21, but also on a further textile part 28 at which the lower ends of the guiding elements 21*b* are fixed to the backpack 20. The textile part 28 comprises mainly a rectangular shape and is also fixed to the backpack 20 and further parts of the backpack 20, respectively. The fixing could be done e.g. by stitching to other elements of the backpack 20, e.g. element 29.

Due to the special arrangement of the locking mechanism 1 via the guiding elements 21 to the backpack 20 the height is adjustable along the guiding elements 21, in particular along the mounted lower and upper ends 21*a*, 21*b* of the guiding elements 21. Thus, the locking mechanism 1 is adjustable relative to the guiding elements 21 in the vertical direction. In FIG. 5 the height of the guiding means 2 and the engaging means 4 is substantially positioned between and in the middle of, respectively, the lower and the upper ends 21*a*, 21*b* of the guiding elements 21.

Figure 6:
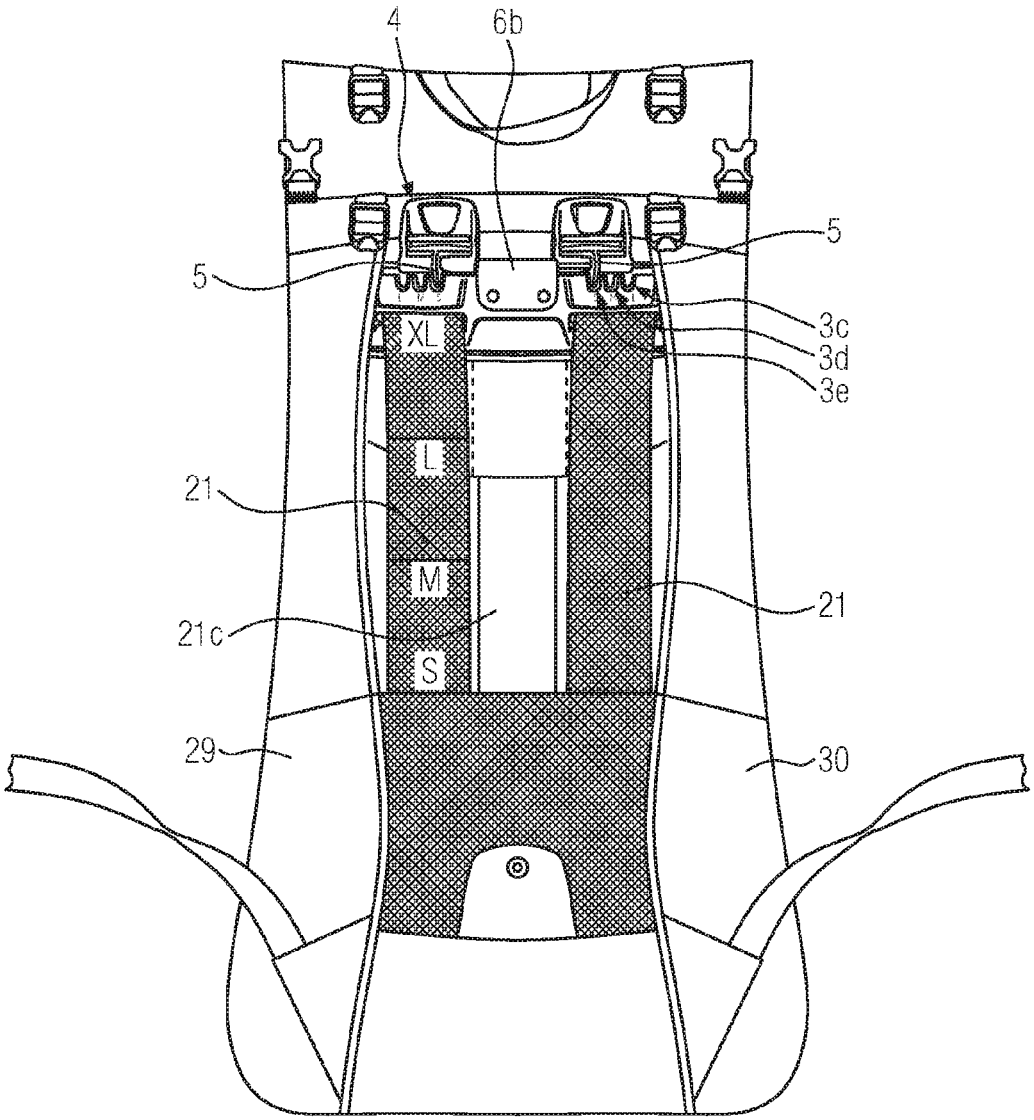
FIG. 6 shows the back of a backpack as well as a mounted locking mechanism in a plan view and in a second relative position to each other.

FIG. 6 shows the back of the backpack 20 as well as a mounted locking mechanism 1 in a plan view and in a second relative position to each other.

In this second relative position of the locking mechanism 1 and the guiding elements 21, the guiding means 2 and the engaging means 4 as well as the retaining means 3 are positioned at the upper ends 21*a* of the guiding elements 21.

While comparing the locking mechanism 1 of FIG. 1 with the locking mechanism 1 shown in FIG. 6 it becomes clear that the backpack 20 forms a pocket with several textile parts, namely the part 28, a left part 29 and a right part 30 of the backpack 20. Especially the left and the right part 29, 30 overlap the left and the right side of the locking mechanism 1 so that the left and the right spacer means 6*a*, 6*b* as shown in FIG. 1 are not visible in FIG. 6 as these spacer means are overlapped by the left and right part 29, 30 of the backpack 20.

Moreover, also the further textile part 28 forms a pocket for the locking mechanism 1, in particular for the textile part 3*b* of the retaining means 3. Thus, a position of the guiding means 2, the retaining means 3 and the engaging means 4 at the lower ends 21*b* of the guiding elements 21 can be realized such that the guides 8 of the retaining means 3 are adjacent to the lower ends 21*b* of the guiding elements 21.

Figure 7A:
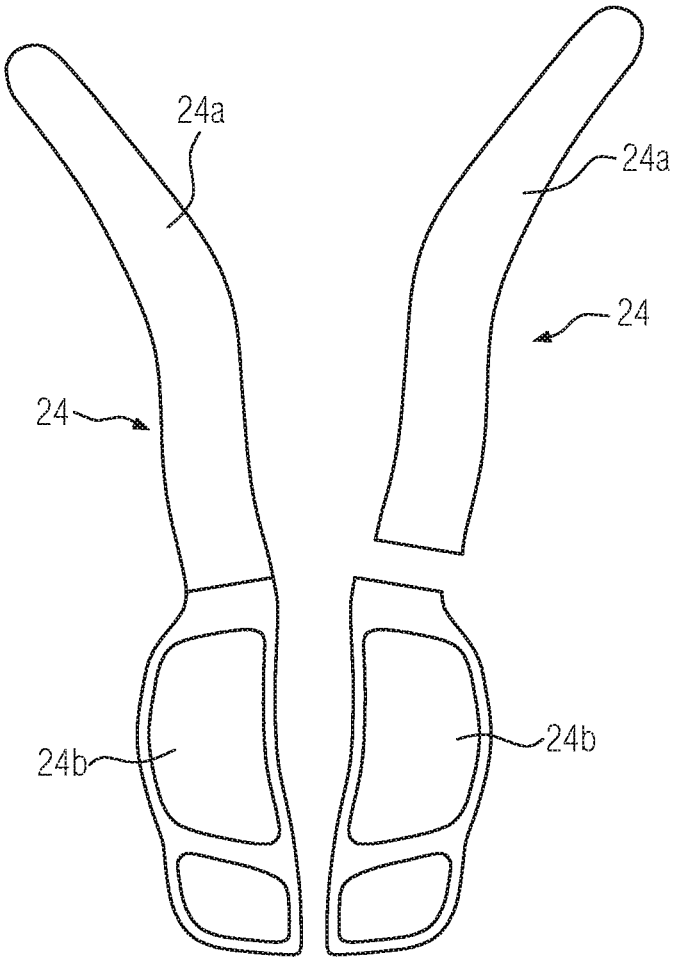
FIG. 7*a* shows a plan view of a front of a shoulder strap.

FIG. 7*a* shows a plan view of a front of a shoulder strap 24. The shoulder strap 24 comprises a pectoral part 24*a* and back part 24*b* each having two ends. The pectoral part 24*a* comprises a slightly curved shape which is anatomically formed such that the part 24*a* runs from the shoulder over the chest to the lower rips of a user. Due to the slightly curved shape of the pectoral part 24*a* the strap runs from the front of the user to the back so that a fixing of the upper end of the pectoral part 24*a* can be fixed to a backpack 20, for example.

Further, on the lower end of the pectoral part 24*a* the back part 24*b* is fixed, in particular sewed. The back part 24*b* comprises several pads for a soft attachment of the back part 24*b* to the back of a user. These two shown shoulder straps 24 in FIG. 7*a* are connected via a pad 23 to a shoulder clasp 22.

Figure 7B:
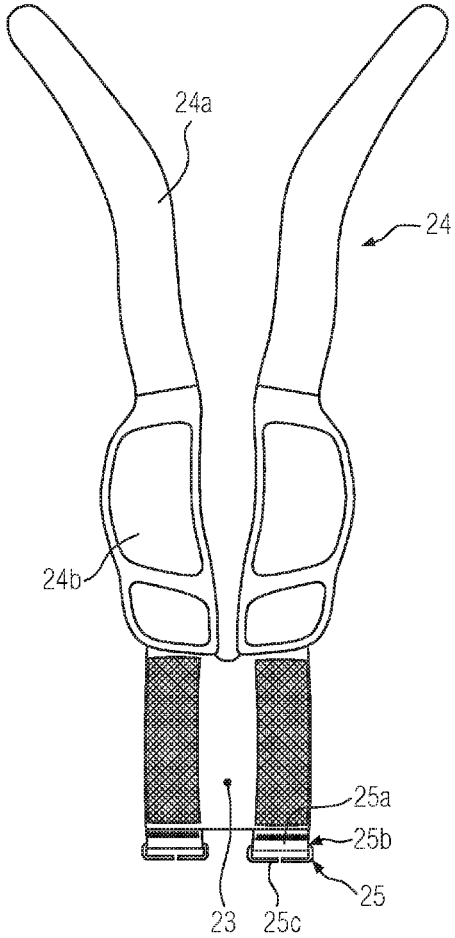
FIG. 7*b* shows a plan view of the front of shoulder clasp.

FIG. 7*b* shows a plan view of the front of the shoulder clasp 22. The shoulder clasp 22 comprises the pad 23 and the shoulder pads of FIG. 7*a*. As already described, the pectoral part 24*a* of the back part 24*b* are connected on one end with an end of the back part 24*b*, wherein—as shown in FIG. 7*b*—to the opposite end of the back part 24*b* (opposite to the end at which the pectoral part 24*a* is fixed) the pad 23 is mounted, preferably sewed.

On the opposite end of the pad 23, opposite to the end fixed to the back part 24*b* a mounting means 25 is attached. These mounting means 25 serve for mounting the shoulder clasp 22 to the locking mechanism 1 and backpack 20, respectively. The mounting means 25 comprise a short strap 25*a* at which a hanger 25*b* is formed. In the hanger 25*b* a rectangular shaped "O" clamp 25*c* is arranged. The "O" comprises a recess so that the clamp 25*c* can be introduced into the hanger 25*b*.

Figure 7C:
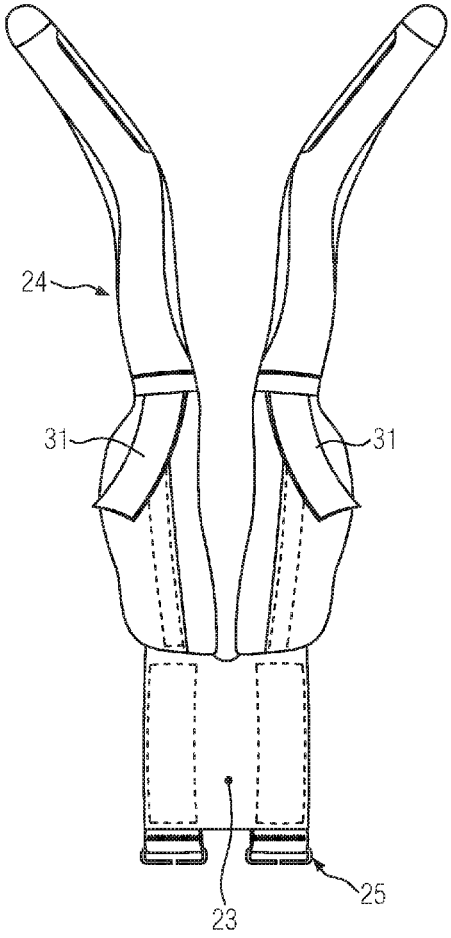
FIG. 7*c* shows a plan view of the back of the shoulder clasp of FIG. 7*b;*

FIG. 7*c* shows a plan view of the back of the shoulder clasp of FIG. 7*b*. As can be seen in FIG. 7*c* at the back of the shoulder clasp 22 a strap 31 is positioned at the point of intersection between the pectoral part 24*a* of the shoulder strap 24 and the back part 24*b*. This strap 31 can be used for mounting the shoulder clasp 22 to the locking mechanism 1 and the engaging means 4, respectively. More concretely, the strap 31 is used to attach the shoulder clasp 22 to the buckle 4*a* of the engaging means 4.

Figure 8A:
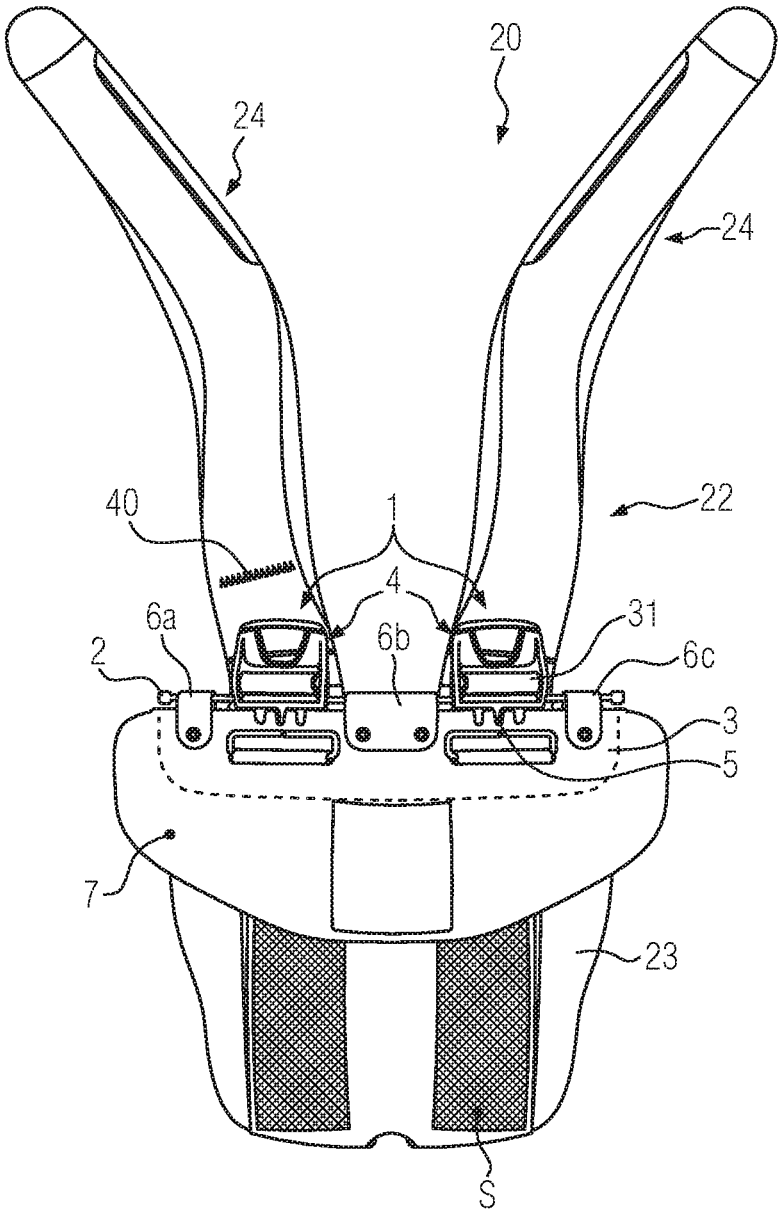
FIG. 8*a* shows a plan view of the back of a shoulder clasp with a locking mechanism mounted thereto.

FIG. 8*a* shows a plan view of the back of a shoulder clasp 22 with a locking mechanism 1 mounted thereto. In this Figure the mounting means 25 of the shoulder clasp 22 is installed by leading the strap 25*a* of the mounting means 25 through the guides 8 of the retaining means 3 and its molded part 3*a*, respectively. Moreover, the "0" shaped clamp 25*c* holds the short strap 25*a* of the pad 23 and the shoulder clasp 22, respectively, via its hanger 25*b* in position. Thus, the clamp 25*c* restricts the movement of the short strap 25*a* in a vertical direction V.

The strap 31 as shown in FIG. 7*c* is guided through the maze of the engaging means 4 so that the bar 4*c* of the engaging means' maze which is positioned in-between the two ports 4*b* is encircled by the strap 31.

Moreover, with regard to FIG. 7*c* one end of the strap 31 is fixed to the shoulder clasp 22, wherein the opposite end is free. This free end is fixed in FIG. 8*a*, namely to the pectoral part 24*a* of the shoulder strap 24. This fixing is shown in FIG. 8*a* as a stitching 40. Thus, while one end of the shoulder clasp 22 having the mounting means 25 is positioned within the guide 8 of the retaining means 3, the other end of the shoulder clasp 22 having the strap 31 is positioned within the maze of the engaging means 4 of the locking mechanism 1 and fixed to the pectoral part 24*a* of the shoulder strap 24. Further, it becomes clear from FIG. 8*a* that a surface of the pad 23 contacts a surface of the back part 24*b*.

Figure 8C:
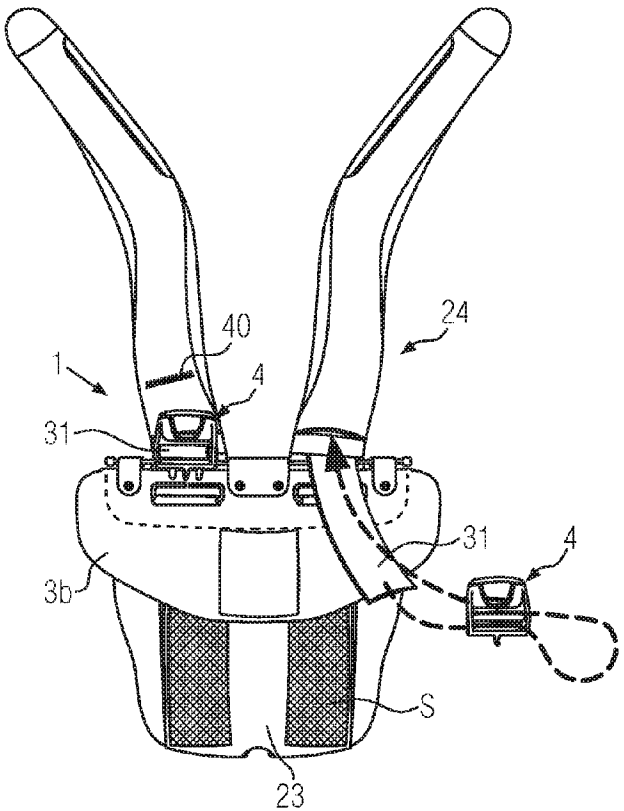
FIG. 8*c* shows a second step of assembling the locking mechanism of FIG. 1 to the back of a shoulder clasp of FIG. 7*c;*
Figure 8B:
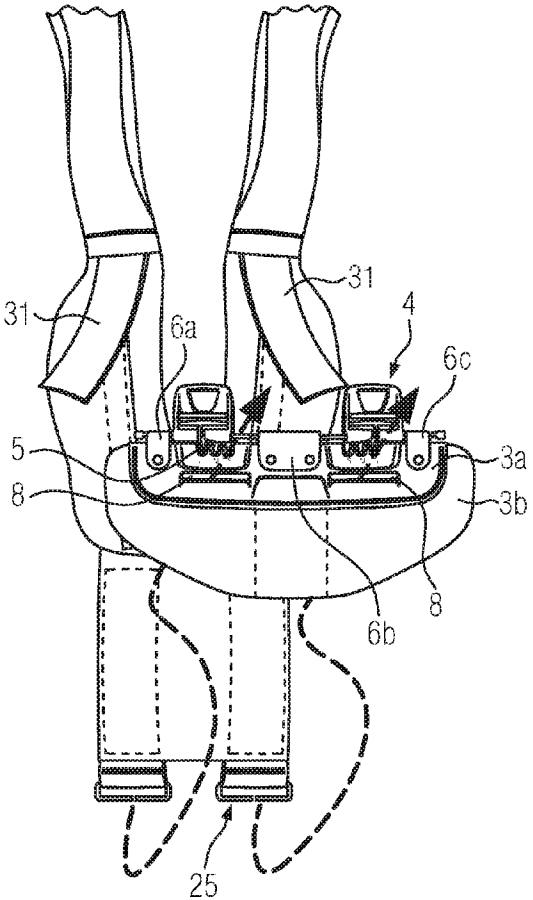
FIG. 8*b* shows a first step of assembling the locking mechanism of FIG. 1 to the back of a shoulder clasp of FIG. 7*c;*

FIG. 8*b* shows a first step of assembling the locking mechanism 1 of FIG. 1 to the back of a shoulder clasp 22 of FIG. 7*c*. In FIG. 8*b* the pathway along which the mounting means 25 have to run through the guides 8 of the retaining means 3 is shown. Here, the short strap 25*a* of the pad 23 is guided by the guides 8 from one side of the retaining means 3 to the other. This ensures a safe arrangement of the pad 23 to the locking mechanism 1 via the guides 8. Further, FIG. 8*b* shows the shoulder clasp 22 of FIG. 7*c* plus the locking mechanism 1 of FIG. 1.

FIG. 8*c* shows a second step of assembling the locking mechanism 1 of FIG. 1 to the back of a shoulder clasp 22 of FIG. 7*c*. Further, in FIG. 8*c* the pathway of the strap 31 of the shoulder claps 22 through the maze of the engaging means 4 is shown.

On the left side of the assembly shown in FIG. 8*c*, the pad 23 and the shoulder strap 24 with its strap 31 is already mounted to the locking mechanism 1 by the stitching 40. On the right side—as already mentioned—the engaging means 4 has to be assembled to the retaining means 3 and the guiding means 2, respectively, wherein a pocket in the shoulder strap 24 and its pectoral part 24*a*, respectively, is shown in which the free end of the strap 31 is introduced after guiding through the maze of the engaging means 4. After insertion of the free end into the pocket a stitching 40 as shown on the left is made.

Figure 9:
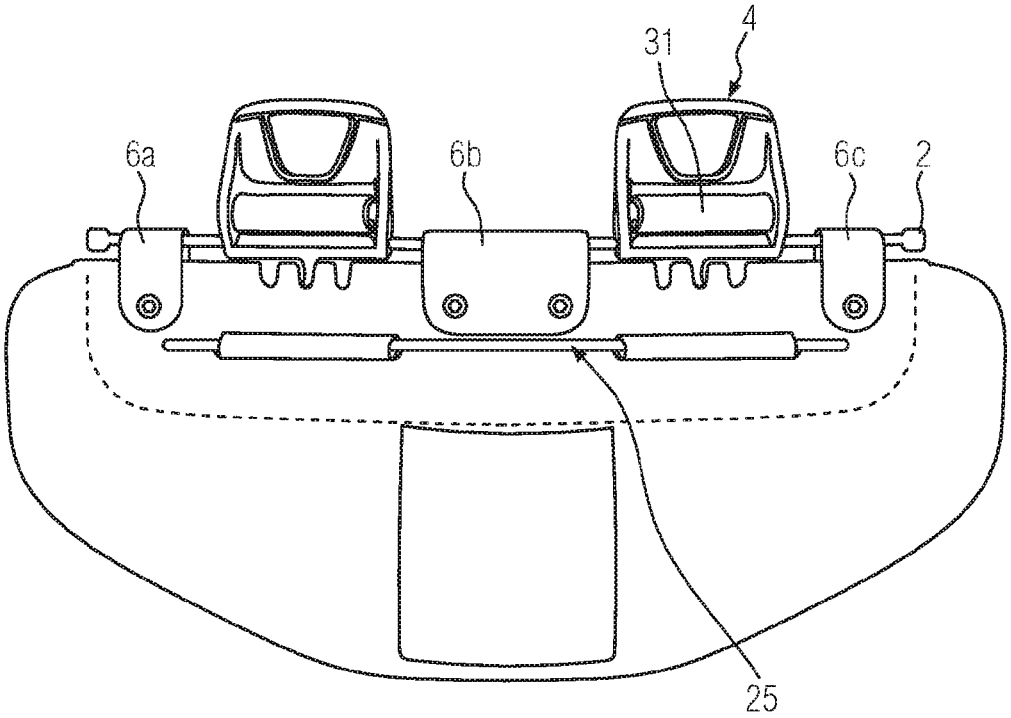
FIG. 9 shows an alternative embodiment to the mounting of the shoulder clasp to the locking mechanism.

FIG. 9 shows an alternative embodiment to the mounting of the shoulder claps 22 to the locking mechanism 1.

Instead of using one mounting means 25 for each guide 8 of the retaining means 3 one mounting means 25 shaped in a bar-like form could be used instead of the two clamps 25*c* shaped in rectangular manner, wherein each clamp 25*c* comprises a recess in which two end surfaces of the clamp face each other. Apart from that, FIG. 9 comprises mainly the same locking mechanism 1 as shown in FIG. 1.

Figure 10:
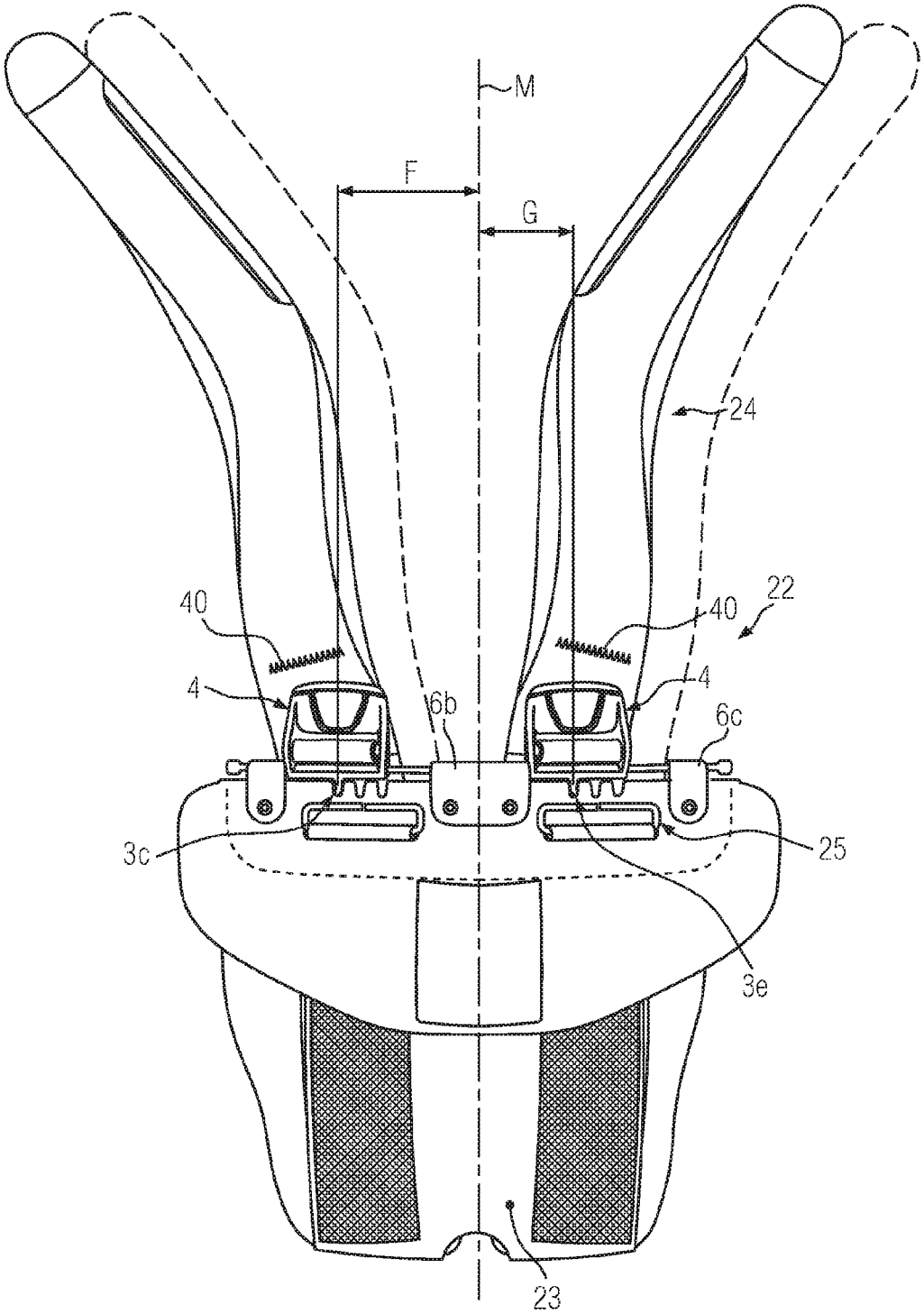
FIG. 10 shows a plan view of a locking mechanism mounted to a shoulder clasp, wherein different positions of a shoulder strap relative to the locking mechanism are shown.

FIG. 10 shows a plan view of a locking mechanism 1 as shown in FIG. 1 mounted to the shoulder clasp 22, wherein different positions of a shoulder strap 24 relative to the locking mechanism 1 are shown.

Moreover, FIG. 10 is mainly identical to FIG. 8*a*, however, the engaging means 4 of the locking mechanism 1 and the two fixed shoulder clasps 22 are positioned differently. With regard to FIG. 8*a* the protrusion 5 of the engaging means 4 engages the retaining means 3 in the second recess 3*d*. However, on the left side in FIG. 10 the engaging means 4 and its protrusion 5, respectively, engage in the first recess 3*c* of the retaining means 3. Thus, the protrusion 5 comprises a distance F to the middle M of the retaining means 3.

Moreover, on the right side in FIG. 10 the engaging means 4 and its protrusion 5, respectively, engage in the third recess 3*e* of the retaining means 3. Thus, the protrusion 5 comprises a distance G to the middle M of the retaining means 3.

By comparing the distances F, G it becomes clear that F is greater that G. Thus, the distance of the protrusion 5 of the engaging means 4 (e.g. on the left in FIG. 10) relative to another engaging means 4 (e.g. on the right in FIG. 10) can be adjusted. Moreover, by adjusting the distances of the engaging means 4 to the middle M of the retaining means 3 an adjustment of the breadth across the shoulders of a user can be made. Hence, by engaging the protrusion 5 of the engaging means 4 with the retaining means 3 in different recesses 3*c*, 3*d*, 3*e* and slots, respectively, such a backpack can be adapted to the breadth across the shoulders of a user having a short breadth across the shoulders or a long breadth.

Figure 11:
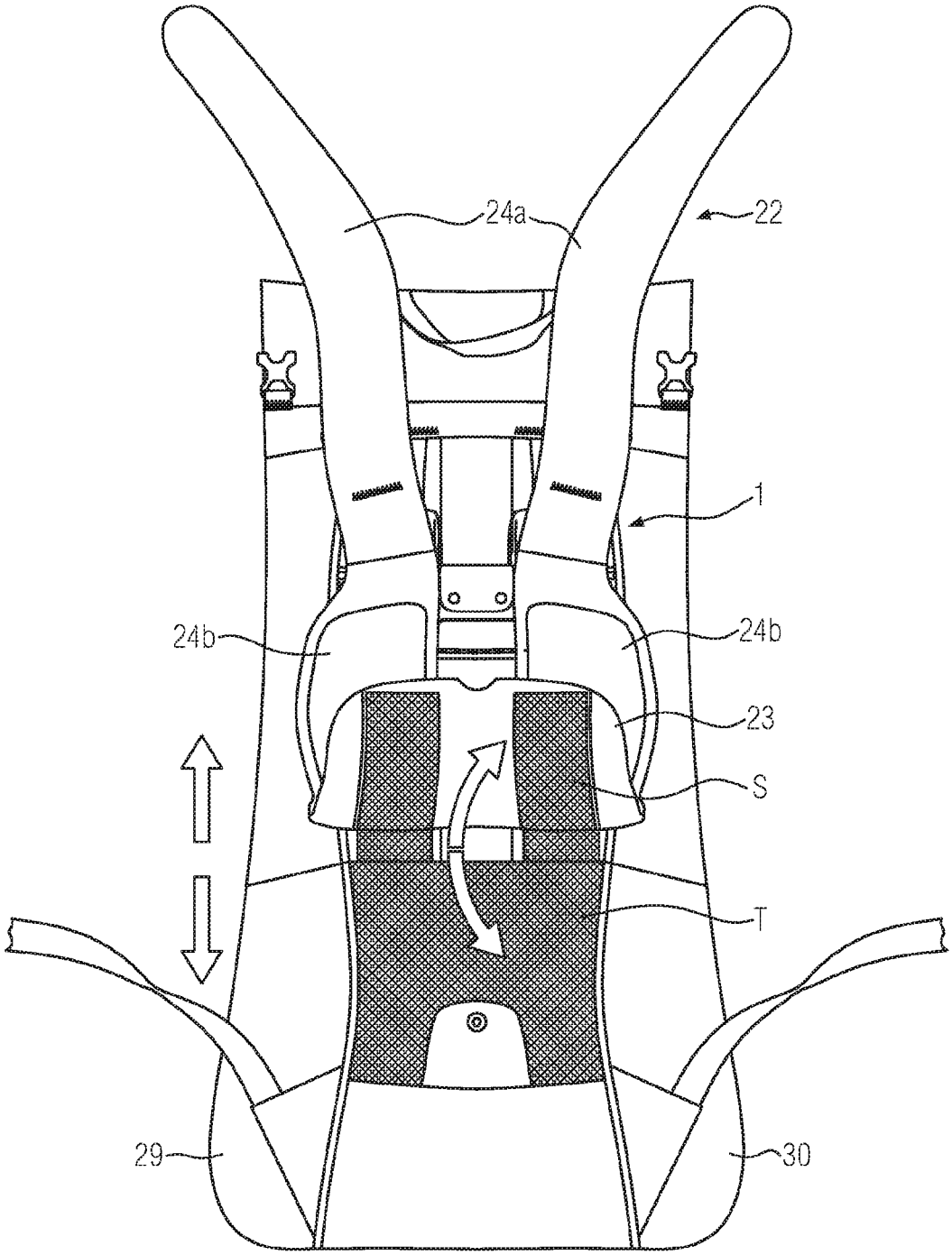
FIG. 11 shows a shoulder clasp with a locking mechanism mounted to the back of a backpack in a plan view.

FIG. 11 shows a shoulder clasp 22 with a locking mechanism 1 mounted to the back of a backpack 20 in a plan view.

As can be understood from FIG. 11, the shoulder strap 24 and the pad 23 are pivotably arranged at the locking mechanism 1.

Further, as already disclosed the guiding elements 21 comprise a surface T having mating members of a hook-and-loop fastener. Moreover, the shoulder clasp 22 and the pad 23, respectively, comprise also mating members of a hook-and-loop fastener on a surface S. Thus, an easy, cost-effective and reliable solution for detaching and attaching is realized.

As also stated to the Figures explained before, the pad 23 is mounted to the retaining means 3 of the locking mechanism 1 and the shoulder strap 24 is mounted to engaging means 4 of the locking mechanism 1. Further, the pad 23 is positioned between the retaining means 3 and the pad 23 of the shoulder clasp 22, wherein the pad 23 is connected to the retaining means 3 and to shoulder straps 24 of the shoulder clasp 22. Hence, the pad 23 is positioned in the middle of the retaining means 3 of the locking mechanism 1 and the shoulder strap 24.

By fixing the pad 23 via the mounting means 25 to the retaining means 3 and its molded part 3*a*, respectively, as well as the shoulder strap 24 to the engaging means 4 a triangle arrangement is formed comprising an acute triangle. In other words, the triangle arrangement having the pad 23, one of the shoulder straps 24 and the retaining means 3 of the locking mechanism 1 comprises two edges on the locking mechanism 1. Hereby, one edge is positioned at the guide 8 and the other edge is positioned at the engaging means 4. In between the afore-mentioned two edges a short side is arranged. The third edge of the triangle opposite to the short side is formed by the connection of the pad 23 with the shoulder strap 24.

The short side between the two edges of the triangle enables a pivoting movement of the third edge of the triangle about the short side. Thus, a triangle and a triangle arrangement, respectively, is realized providing a pivoting movement of one acute angle about its opposite short side.

Hence, due to a rotation about the locking mechanism 1 a detachable manner such that the surfaces S, T of the pad 23 and the guiding elements 21, respectively, can be any number of times detached and attached from and to, respectively, each other.

Further, the pad 23 and a part of the shoulder strap 24 are superposed. The surfaces S, T of the pad 23 and the shoulder strap 24 are in contact with each other, wherein FIG. 11 shows the backpack 20 in a state in which the back part 24*b* of the shoulder strap 24 and its surface S, respectively, is realizing the connection with the guiding elements 21 and the further textile part 28. This is done by pivoting the back part 24*b* and the pad 23 about the engaging means 4 and the guides 8, respectively.

Regarding FIG. 11, the backpack 20 is shown in the change from a first state to a second. In a first state the shoulder clasp 22 interacts with the guiding elements 21 and the further textile part 28 such that the relative position of the locking mechanism 1 and the at guiding element 21 is restricted. In this state the hook and loop fastener is engaged so that the locking mechanism 1 cannot be moved relatively to the guiding elements 21.

In a second state the contact of the shoulder clasp 22 with the guiding element 21 is inhibited such that the relative position of the locking mechanism 1 and the guiding elements 21 and the further textile part 28 is released from each other concerning their surface S, T.

In the second state in which the mating members of the guiding elements 21 and the shoulder clasp 22, in particular the pad 23, are spaced from each other there is no interaction between mating members. Thus, the position of the shoulder clasp 22 and the guiding elements 21 or the guiding element 21 and the pad 23 of the shoulder clasp 22 can be adjusted to any desired position. This adjustment is realized by moving the locking mechanism and the shoulder clasp along the guiding elements 21 in a substantially vertical direction V, wherein the guiding elements 21 predetermines the direction of movement of the locking mechanism 1.

Describing the above mentioned in other words, in the first state in which the shoulder clasp 22 interacts with the guiding elements 21, the pad 23 of the clasp 22 is in contact with the guiding elements 21 via mating members on the surface S, T. By this the position of the locking mechanism 1 relative to the guiding elements 21 is also fixed. This is because the shoulder clasp 22 and its pad 23, respectively, is connected to the locking mechanism 1 and the engaging means 4, respectively. This means that the locking mechanism 1 cannot be moved along the guiding elements 21. Thus, there is no adjustability in the first state.

In the second state in which the shoulder clasp 22 comprises no interaction with the guiding elements 21 the pad 23 of the clasp 22 is spaced from the guiding elements 21 so that no mating members on the surfaces S, T can engage. This is realized e.g. by pivoting the pad 23 of the shoulder clasp 22 about the locking mechanism 1. This enhances the distance between the pad 23 and the guiding elements 21.

To switch between the first and second state the pad 23 and the superposed back part 24*b* of the shoulder strap 24 is rotated. In this first state and rotational state, respectively, the relative position of the guiding elements 21 and the locking mechanism 1 along the guiding elements 21 is inhibited. This means that the locking mechanism 1 cannot be slid along the guiding elements 21. This is because mating members of the guiding elements 21 engages with the pad 23, wherein the pad 23 is rotatably connected to the locking mechanism 1 and the engaging means 4, respectively.

Further, the pad 23 is rotated in the second state so that the mating members on the surfaces S, T of the pad 23 and the guiding elements 21 are disengaged with each other. By this, the locking mechanism 1 is can be slid along the guiding elements 21 which means that the relative position along the guiding elements 21 of the backpack 20 and the locking mechanism 1 is variable. Moreover, in the second state the locking mechanism 1 is freely movable along the guiding elements 21 in a vertical direction V.

What is claimed is:

1. A backpack, comprising:

a main body;

an adjustable shoulder strap;

a guiding element coupled to the main body of the backpack, the guiding element having a length in a lengthwise direction of the main body of the backpack;

a retaining element coupled to the guiding element and configured to translate along the length of the guiding element to adjust a position of the shoulder strap in the lengthwise direction of the main body of the backpack, the retaining element having a lateral width in a lateral direction of the main body of the backpack; and an engaging element configured to couple the shoulder strap with the retaining element, wherein the engaging element is configured to translate along a portion of the lateral width of the retaining element to adjust a position of the shoulder strap in the lateral direction of the main body of the backpack.

2. The backpack according to claim 1, wherein the engaging element is coupled to the retaining element along a guide disposed along the lateral width of the retaining element.

3. The backpack according to claim 2, wherein the engaging element is configured to laterally translate along the guide to adjust the position of the shoulder strap in the lateral direction of the main body of the backpack.

4. The backpack according to claim 1, wherein the length of the guiding element and the lateral width of the retaining element are substantially perpendicular.

5. The backpack according to claim 1, wherein the engaging element comprises at least one protrusion configured to engage at least one recess in the retaining element.

6. The backpack according to claim 5, wherein a plurality of recesses are disposed along the lateral width of the retaining element.

7. The backpack according to claim 6, wherein the engaging element is configured to engage a first recess corresponding to a first lateral position of the shoulder strap and a second recess corresponding to a second lateral position of the shoulder strap.

8. The backpack according to claim 6, wherein the recesses are configured to inhibit lateral translation of the engaging element.

9. The backpack according to claim 1, wherein the retaining element comprises a guide slot through which the guiding element passes.

10. The backpack according to claim 1, further comprising a hook-and-loop fastener coupled to the retaining element and configured to fasten the retaining element to the guiding element to inhibit translation of the retaining element along the guiding element.

11. The backpack according to claim 1, further comprising:

a second adjustable shoulder strap; and a second engaging element configured to couple the second shoulder strap with the retaining element, wherein the second engaging element is configured to translate along a portion of the lateral width of the retaining element to adjust a position of the second shoulder strap in the lateral direction of the main body of the backpack.

12. The backpack according to claim 11, wherein the second engaging element is coupled to the retaining element along a second guide disposed along the lateral width of the retaining element, and wherein the second engaging element is configured to laterally translate along the second guide to adjust the position of the second shoulder strap in the lateral direction of the main body of the backpack.

13. A locking mechanism for a shoulder strap of a backpack, comprising:

a retaining element having a lateral width extending in a substantially horizontal direction of the backpack;

an elongate guide;

an engaging element slidably coupled with the elongate guide and configured to support the shoulder strap of the backpack; and at least one guiding element coupled to the retaining element and having a length extending in a substantially vertical direction of the backpack, wherein the engaging element is configured to slide along the elongate guide such that a position of the shoulder strap of the backpack can be adjusted in the horizontal direction of the backpack.

14. The locking mechanism according to claim 13, wherein the guiding element extends through at least one slot in the retaining element of the locking mechanism.

15. The locking mechanism according to claim 13, wherein the engaging element comprises a protrusion configured to engage a slot of the retaining element.

16. The locking mechanism according to claim 15, wherein the retaining element comprises at least two slots corresponding to the protrusion of the engaging element, and wherein the engaging element is configured to engage a first slot corresponding to a first lateral position of the shoulder strap and a second slot corresponding to a second lateral position of the shoulder strap.

17. The locking mechanism according to claim 13, wherein the retaining element comprises at least three slots configured to be engaged by the engaging element.

18. The locking mechanism according to claim 13, wherein the retaining element is configured to slide along the guiding element in the vertical direction of the backpack.

19. The locking mechanism according to claim 13, further comprising a hook-and-loop fastener coupled to the retaining element and configured to fasten the retaining element to the guiding element.

20. The locking mechanism according to claim 13, wherein the locking mechanism is configured to couple the shoulder strap to a main body of the backpack.

* * * * *